US007798435B2

(12) United States Patent
Matlin

(10) Patent No.: US 7,798,435 B2
(45) Date of Patent: Sep. 21, 2010

(54) SHREDDER WITH OILING MECHANISM

(75) Inventor: Tai Hoon Matlin, Round Lake Beach, IL (US)

(73) Assignee: Fellowes, Inc., Itasca, IL (US)

( * ) Notice: Subject to any disclaimer, the term of this patent is extended or adjusted under 35 U.S.C. 154(b) by 939 days.

(21) Appl. No.: 11/385,864

(22) Filed: Mar. 22, 2006

(65) Prior Publication Data

US 2007/0221767 A1 Sep. 27, 2007

(51) Int. Cl.
*A01F 21/00* (2006.01)
*B23Q 11/00* (2006.01)

(52) U.S. Cl. ..... 241/37.5; 241/100; 241/236

(58) Field of Classification Search ..... 241/100, 241/236, 37.5
See application file for complete search history.

(56) References Cited

U.S. PATENT DOCUMENTS

| | | | |
|---|---|---|---|
| 3,724,766 | A | 4/1973 | Bosland |
| 4,489,897 | A | 12/1984 | Turner |
| 4,497,478 | A | 2/1985 | Reschenhofer |
| 4,707,704 | A | 11/1987 | Allen |
| 4,757,949 | A | 7/1988 | Horton |
| 4,842,205 | A | 6/1989 | Araki |
| 5,017,972 | A | 5/1991 | Daughton |
| 5,186,398 | A | 2/1993 | Vigneaux, Jr. |
| 5,342,033 | A | 8/1994 | Iwata |
| 5,415,355 | A | 5/1995 | Gollwitzer |
| 5,429,313 | A | 7/1995 | Schwelling |
| 5,494,229 | A | 2/1996 | Rokos et al. |
| 5,775,605 | A | 7/1998 | Tsai |
| 5,823,529 | A | 10/1998 | Mandel |
| 6,418,004 | B1 | 7/2002 | Mather |
| 6,550,701 | B1 | 4/2003 | Chang |
| 6,698,640 | B2 | 3/2004 | Hakozaki |
| 7,166,561 | B2 | 1/2007 | Allen |
| 2004/0194594 | A1 | 10/2004 | Dils |
| 2004/0226800 | A1 | 11/2004 | Pierga |
| 2005/0150986 | A1 | 7/2005 | Castronovo |
| 2006/0016919 | A1 | 1/2006 | Castronovo |
| 2006/0054725 | A1 | 3/2006 | Matlin |
| 2006/0243631 | A1 | 11/2006 | Duke |
| 2007/0080252 | A1 | 4/2007 | Pierce |
| 2007/0087942 | A1 | 4/2007 | Allen |
| 2007/0164135 | A1 | 7/2007 | Zhong |
| 2007/0164138 | A1 | 7/2007 | Allen |
| 2007/0215728 | A1 | 9/2007 | Priester |

FOREIGN PATENT DOCUMENTS

| | | |
|---|---|---|
| DE | 8619856.4 | 7/1986 |
| DE | 41 21 330 | 1/1993 |

(Continued)

OTHER PUBLICATIONS

Partial International Search Report issued with Invitation to Pay Additional Fees issued in PCT/US2008/078458, Jan. 26, 2009, 2 pages.

(Continued)

*Primary Examiner*—Bena Miller
(74) *Attorney, Agent, or Firm*—Pillsbury Winthrop Shaw Pittman LLP

(57) ABSTRACT

The present invention relates to a shredder with an automated lubricating system.

12 Claims, 8 Drawing Sheets

FOREIGN PATENT DOCUMENTS

| | | | |
|---|---|---|---|
| DE | 19835093 | A1 | 2/1999 |
| DE | 20 2004 000907 | | 5/2005 |
| DE | 102006036136 | A1 | 1/2008 |
| EP | 2022566 | A | 2/2009 |
| GB | 1199903 | | 7/1970 |
| GB | 2 171 029 | | 8/1986 |
| GB | 2 440 651 | A | 2/2008 |
| JP | 52-11691 | | 1/1977 |
| JP | 06 277548 | A | 10/1994 |
| JP | 2002-239405 | | 8/2002 |
| JP | 2004 321993 | A | 11/2004 |
| WO | 2005/070553 | | 8/2005 |
| WO | 2006/036370 | | 4/2006 |
| WO | 2007/109753 | A2 | 9/2007 |
| WO | 2007/122364 | | 11/2007 |

OTHER PUBLICATIONS

International Search Report (PCT/ISA/210) issued in PCT/US2007/0064601, mailed Feb. 8, 2008, 5 pages.

Written Opinion of the International Searching Authority (PCT/ISA/237) issued in PCT/US2007/0064601, mailed Feb. 8, 2008, 16 pages.

English Abstract of German patent application No. DE 1020006036136 of Erlecke, published Jan. 31, 2008.

European Search Report issued in EP 08 17 0857, Feb. 10, 2009, 6 pages.

European Search Report issued in Applicaiton No. 08102126.3, May 19, 2008, 5 pages.

U.S. Appl. No. 60/686,490, filed May 31, 2005, Pierce.

U.S. Appl. No. 60/613,750, filed Sep. 27, 2004, Pierce.

U.S. Appl. No. 60/688,285, filed Jun. 7, 2005, Pierce.

Manual Translation of Japanese application 2004-321993, published Nov. 18, 2004.

Manual Translation of Japanese application 2002-239405, published Aug. 27, 2002.

Invitation to Pay Additional Fees with Partial International Search Report in PCT/US2007/064601, Sep. 12, 2007, 8 pages.

International Search Report for PCT/US2008/078458, mailed on Mar. 30, 2009.

SHREDDER WITH OILING MECHANISM

FIELD OF THE INVENTION

The present invention relates to shredders for destroying articles, such as documents, CDs, etc.

BACKGROUND OF THE INVENTION

Shredders are well known devices for destroying substrate articles, such as documents, CDs, floppy disks, etc. Typically, users purchase shredders to destroy sensitive articles, such as credit card statements with account information, documents containing company trade secrets, etc.

Typically, a shredder has a shredder mechanism contained within a housing, and the housing has a feed opening enabling substrates to be fed into the shredder mechanism. As with other mechanical devices, wear may be reduced and performance may be maintained by proper lubrication of moving parts. In particular, wear on cutting blades of the shredder mechanism and load on the shredder motor can be reduced by oiling the cutting blades.

SUMMARY OF THE INVENTION

One aspect of the present invention provides a shredder for shredding substrates with an oiling mechanism. The shredder includes a housing, a shredder mechanism received in the housing and including a motor and cutter elements, the shredder mechanism enabling substrates to be shredded to be fed into the cutter elements and the motor being operable to drive the cutter elements in a shredding direction so that the cutter elements shred the substrates fed therein, the housing having a feed opening enabling the substrates to be shredded to be fed into the cutter elements, a reservoir constructed to contain an amount of fluid lubricant, a plurality of nozzles communicated with the reservoir, and a pump, operable to deliver the fluid under pressure to the plurality of nozzles such that the fluid is sprayed to lubricate the cutter elements.

In certain embodiments, the oiling mechanism includes one or more nozzles in fluid communication with a pump. The pump is in turn in fluid communication with a fluid reservoir for containing the lubricant. When activated, the pump pumps lubricant from the reservoir through the nozzle or nozzles to provide the lubricant to the cutter elements. In a particular embodiment, the lubricant is provided to the cutter elements directly. In another variation, the lubricant is provided to an intermediate surface from whence it flows to the cutter elements.

In another embodiment, the shredder incorporates a controller that is configured and arranged to control a schedule of lubrication. The controller may control the schedule according to a predetermined time schedule, according to a predetermined number of uses, or it may control the schedule according to a measured or estimated number of sheets shredded.

One aspect of an embodiment of the present invention includes a retrofittable lubricating kit for use with a shredder for shredding substrates, the shredder including a housing, a shredder mechanism received in the housing and including a motor and cutter elements, the shredder mechanism enabling substrates to be shredded to be fed into the cutter elements and the motor being operable to drive the cutter elements in a shredding direction so that the cutter elements shred the substrates fed therein, the housing having a feed opening enabling the substrates to be shredded to be fed into the cutter elements, including a reservoir constructed to contain an amount of fluid lubricant, a plurality of nozzles communicated with the reservoir, and a pump, operable to deliver the fluid under pressure to the plurality of nozzles such that the fluid is sprayed to lubricate the cutter elements.

Other objects, features, and advantages of the present invention will become apparent from the following detailed description, the accompanying drawings, and the appended claims.

DETAILED DESCRIPTION OF THE ILLUSTRATED EMBODIMENTS

Figure 1:
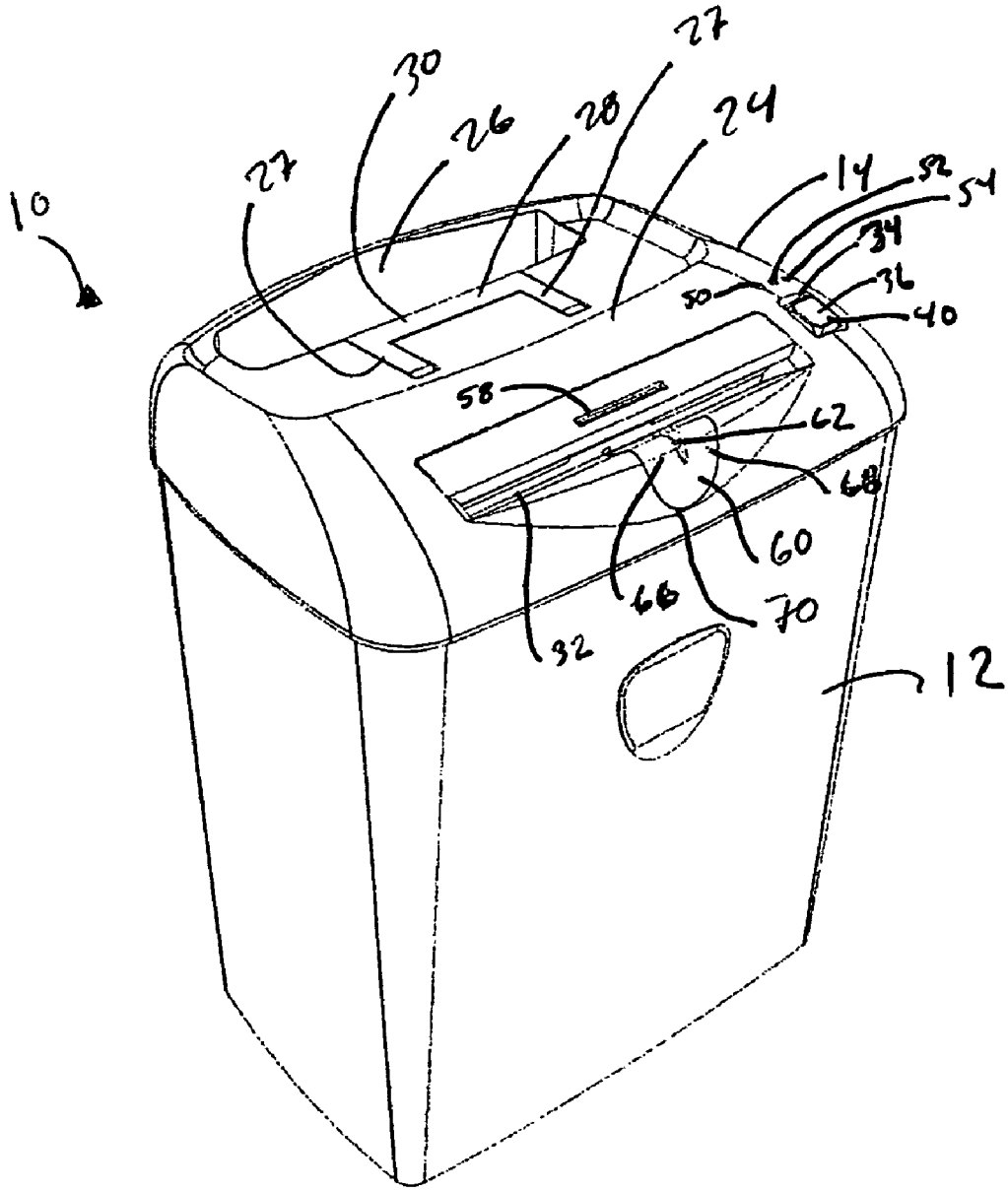
FIG. 1 is a perspective view of a shredder constructed in accordance with an embodiment of the present invention.

FIGS. 1-4 illustrate an embodiment of a shredder constructed in accordance with one embodiment of the present invention. The shredder is generally indicated at 10. The shredder 10 sits atop a waste container, generally indicated at 12, which is formed of molded plastic or any other material. The shredder 10 illustrated is designed specifically for use with the container 12, as the shredder housing 14 sits on the upper periphery of the waste container 12 in a nested relation. However, the shredder 10 may be of the type provided with an adaptable mount for attachment to a wide variety of containers, or may be part of a freestanding frame with a compartment that receives a removable waste container. Generally speaking, the shredder 10 may have any suitable construction or configuration and the illustrated embodiment is not intended to be limiting in any way.

The shredder 10 includes a shredder mechanism 16 including an electrically powered motor 18 and a plurality of cutter elements 20. The cutter elements 20 are mounted on a pair of parallel rotating shafts (not shown). The motor 18 operates using electrical power to rotatably drive the shafts and the cutter elements 20 through a conventional transmission (not shown) so that the cutter elements 20 shred articles fed therein. The shredder mechanism 16 may also include a subframe for mounting the shafts, the motor 18 and the transmission. The operation and construction of such a shredder mechanism 16 are well known and need not be described herein in detail. The shredder mechanism 16, motor 18, and cutter elements are represented schematically in FIG. 8. Generally, any suitable shredder mechanism known in the art or developed hereafter may be used. For example, reference may be made to U.S. application Ser. Nos. 10/828,254; 10/815,761 and 10/347,700; and U.S. Pat. Nos. 6,260,780; 5,961,059; 5,961,058; 5,954,280; 5,829,697; 5,826,809; 5,799,887; 5,676,321; 5,655,725; 5,636,801; 5,511,732; 5,295,633 and 5,071,080 for details of various shredder mechanisms. Each of these patents and applications is incorporated into the present application by reference in their entirety.

The shredder 10 also includes the shredder housing 14, mentioned above. The shredder housing 14 includes a top wall 24 that sits atop the container 12. The top wall 14 is molded from plastic and a waste opening 26 is located at a rear portion thereof. The opening 26 allows waste to be discarded into the container 12 without being passed through the feed opening 32 and the shredder mechanism 16, as discussed below. As an optional feature, this opening 26 may be provided with a lid, such as a pivoting lid, that opens and closes the opening 26. However, this opening is optional and may be omitted entirely.

Additionally, the top wall 24 has a handle 28 pivotally connected to it and adjacent the waste opening 26. The handle 28 is pivoted at the ends of its legs 27 and can be pivoted upwardly so that its hand grip portion 30 can be grasped. This makes it easier for the user to lift the shredder mechanism 16 off the waste container 12. The handle 30 is entirely optional. In the illustrated embodiment, the top wall 24 has a relatively flat upper area where the handle 28 and waste opening 26 are located, and curves downwardly at its front, side, and rear areas. However, the shredder housing 14 and its top wall 24 may have any suitable construction or configuration.

The top wall 24 has a generally laterally extending feed opening 32 extending generally parallel and above the cutter elements 20. The feed opening 32, often referred to as a throat, enables the articles being shredded to be fed into the cutter elements 20. The opening 32 may have any configuration.

The top wall 24 also has a switch recess 34 with an opening (not shown) therethrough. A main switch 36 includes a switch module 38 mounted to the top wall 24 underneath the recess 34 by fasteners, and a movable manually engageable portion 40. Movement of the manually engageable portion 40 moves the switch module between its states.

Figure 8:
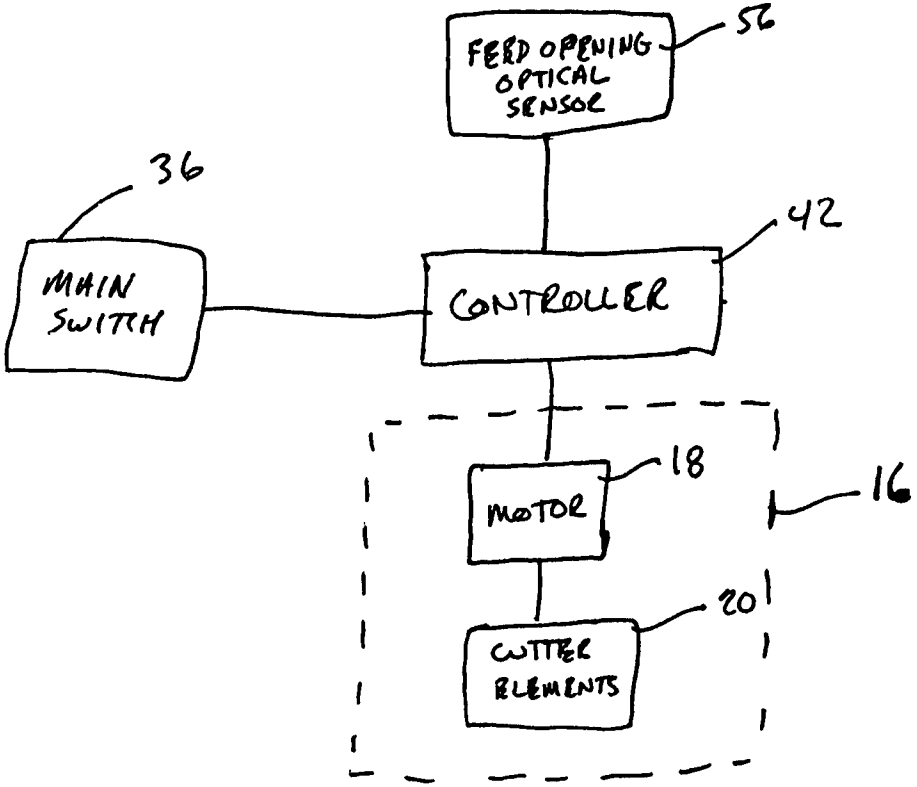
FIG. 8 is a schematic block diagram of various operational components of a shredder.
Figure 9:
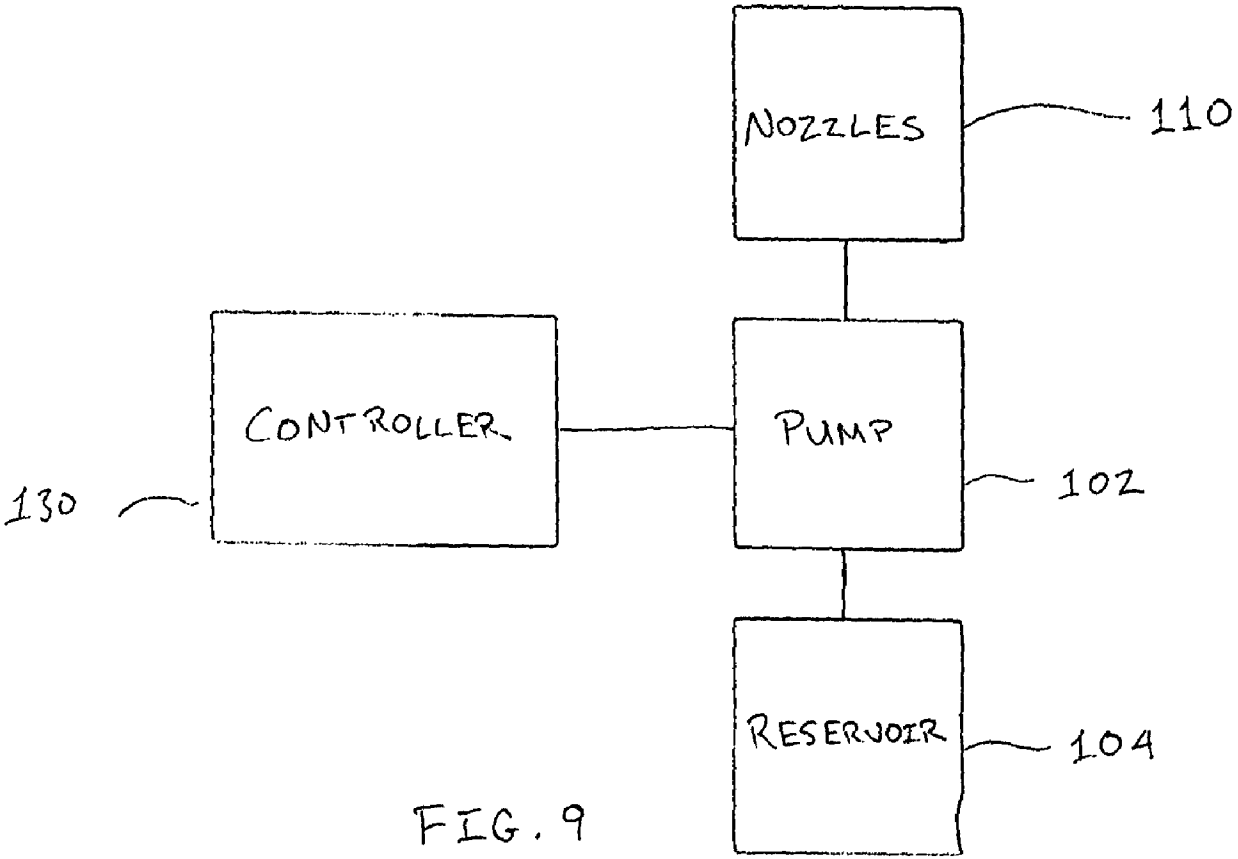
FIG. 9 is a schematic block diagram of various operational components of an embodiment of an oiling mechanism in accordance with an embodiment of the present invention.

In the illustrated embodiment, the switch module 38 is communicated to a controller 42, which is shown as including a printed circuit board 44. Typically, a power supply (not shown) is connected to the controller 42 by a standard power cord 46 with a plug 48 on its end that plugs into a standard AC outlet. The controller 42 is likewise communicated to the motor 18. When the main switch 36 is moved to an on position, the controller 42 can send an electrical signal to the drive the motor 18 so that it rotates the cutting elements 20 in a shredding direction, thus enabling articles fed in the feed opening 26 to be shredded. The switch 36 may also be moved to an off position, which causes the controller 42 to stop operation of the motor 18. The switch module 38 contains appropriate contacts for signaling the position of the switch's manually engageable portion 40. The motor 18, controller 42, main switch 36, and cutters 20 are shown schematically in FIG. 8. Although FIG. 8 shows a sensor 74, that component can be ignored, as it is not used in the embodiments of FIGS. 1-4.

As an option, the switch 36 may also have a reverse position that signals the controller 42 to operate the motor 18 in a reverse manner. This would be done by using a reversible motor and applying a current that is of a reverse polarity relative to the on position. The capability to operate the motor 18 in a reversing manner is desirable to move the cutter elements 20 in a reversing direction for clearing jams. To provide the on, off, and reverse positions, the switch 36 used may be a three position rocker switch (or a two position switch if only two positions are used). Also, the switch 36 may be of the push switch type that is simply depressed to cycle the controller through the three (or two) conditions.

Generally, the construction and operation of the switch 36 and controller 42 for controlling the motor 18 are well known and any construction for these may be used. For example, a touch screen switch, a membrane switch, or a toggle switch are other examples of switches that may be used. Also, the switch need not have distinct positions corresponding to on/off/reverse, and theses conditions could be states selected in the controller by operation of the switch. The particular condition (e.g., on, off, reverse) could be signaled by the lights 50, 52, 54 (discussed below), on a screen, or otherwise.

To assist the user in visually verifying the operational status of the shredder 10, three optional lights 50, 52, 54 are provided. Light 50 to the left corresponds to the on position of the switch 36, which means that the shredder mechanism 16 is on and ready to shred. Light 52 in the middle correspond to the off position of the switch 36, and indicates that the shredder 10 is plugged in and ready to be activated. Light 54 to the right corresponds to the reverse position of the switch 36, and indicates that the shredder mechanism 16 is operating in reverse. Any type of lights, such as LEDs may be used, and all or some of the lights can be eliminated.

An optical sensor 56 may be provided in the feed opening 32. When the switch 36 is in its on position, the controller 42 may be configured to operate the motor 18 to drive the cutter elements 20 in the shredding direction only upon the optical sensor 56 being triggered. Specifically, the optical sensor 56 includes a transmitter and a receiver located within the feed opening 32.

The transmitter emits a light beam to the receiver across the opening 32. When a paper or other article is inserted into the opening, it will interrupt the light beam, and this is sensed by the receiver, which is communicated to the controller 42. Based on this, assuming that the switch 36 is in the on position, the controller 42 then activates the motor 18 to drive the cutter elements 20 in the shredding direction. The use of such a sensor is desirable because it allows the user to ready the shredder 10 by moving the switch 36 to its on position, but the controller 42 will not operate the shredder mechanism 16 to commence shredding until the sensor 56 detects the presence of one or more substrates in the feed opening 32. Once the substrates have passed into the shredding mechanism 16 beyond the sensor 56, the controller 42 will then stop the shredding mechanism 16, as that corresponds to the substrates having been fully fed and shredded. Typically, a slight delay, such as 3-5 seconds, is used before stopping the shredding mechanism 16 to ensure that the substrates have been completely shredded and discharged from the shredder mechanism 16. This is beneficial because it allows the user to perform multiple shredding tasks without having the shredder mechanism 16 operating, and making noise, between tasks. It also reduces wear on the shredder mechanism 16, as it will only operate when substrates are fed therein, and will not continually operate. Other sensors besides an optical sensor may be used, but an optical sensor is preferred because it has no mechanical parts and is less susceptible to wear.

As an optional feature, a narrow opening 58 may be provided adjacent the feed opening 32 for insertion of more rigid articles, such as CDs and credit cards. As can be seen in the drawings, this opening 58 is much narrower in the transverse direction of the shredder 10 than the feed opening 32. Also, it has a smaller width to restrict the number of articles that can be inserted, thus preventing overloading and jamming. This opening 58 leads into the feed opening 32, and articles inserted through the opening 58 will trigger the same optical sensor 56 as discussed above. While it is possible for a user to insert such articles through the larger feed opening 36, the smaller size of opening 58 typically encourages users to use it for feeding such articles.

To help prevent the user from feeding a stack of substrates that is overly thick into the shredder mechanism 16, a stack thickness gauge 60 is optionally provided. The stack thickness gauge 60 has a substrate receiving opening 62 configured to receive an edge portion of a stack of substrates 64 therein. In the illustrated embodiment, the stack thickness gauge includes two upwardly extending structures 66, 68 spaced apart to define the opening 64. These structures 66, 68 are part of an integral molded plastic part that snaps into a recess 70 on a front portion of the top wall 24 adjacent the feed opening 32. The snap-fit projections 72 for securing the gauge 60 in the recess 70 can be seen in FIG. 4, and corresponding receiving holes are provided in the recess 70. The gauge 60, however, may have any construction. For example, it may be constructed as an integrated part of the housing 14, instead of as a part that is separate and attachable to it. Likewise, it may be placed in another location, and its opening 62 may have a different orientation, such as horizontal or at an angle.

The width of the substrate opening 62 is less than or equal to a maximum thickness of a stack of substrates that the shredder mechanism 16 is capable of shredding. This width will vary from shredder to shredder, and depends on factors such as cutter efficiency and motor power. However, any given shredder is limited as to how thick of a stack of substrates it can handle at one time. Above this limit, the shredder mechanism 16 is liable to jam, requiring the user to reverse the shredder mechanism 16 or otherwise remove the substrates from the mechanism 16 for re-feeding in smaller stacks.

Figure 2:
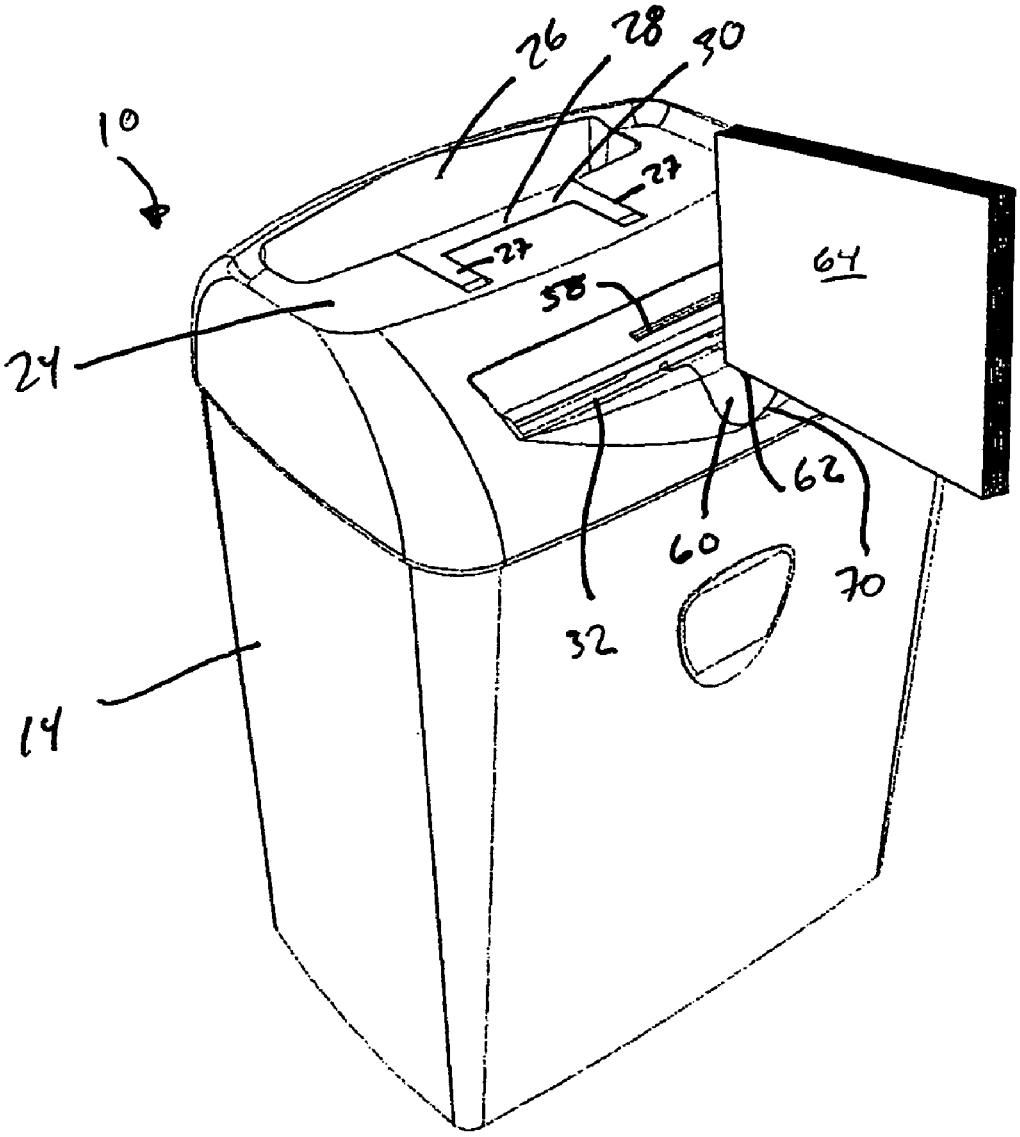
FIG. 2 is a perspective view similar to FIG. 1, showing a stack of documents that is too thick to be inserted into a thickness gauge on the shredder.
Figure 3:
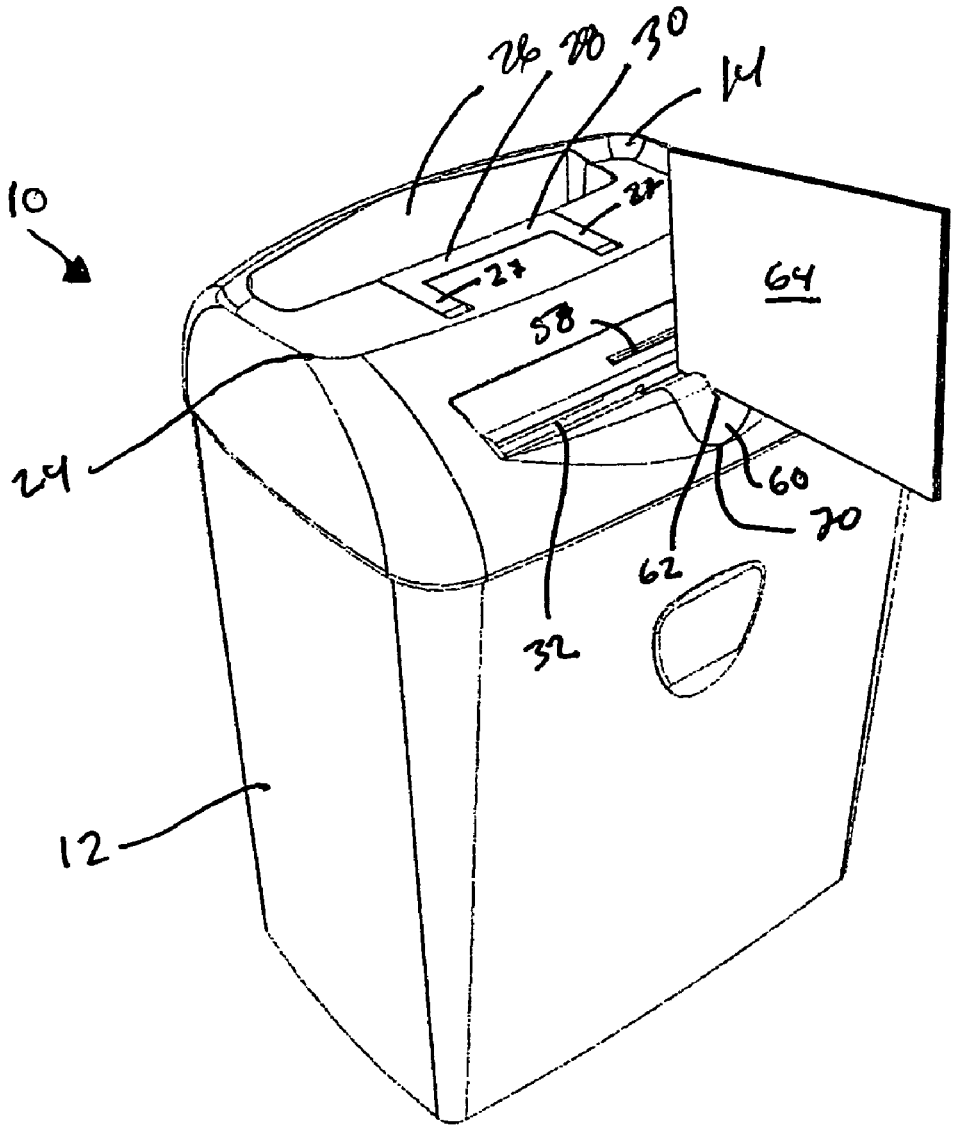
FIG. 3 is a perspective view similar to FIG. 2, but with a thinner stack of documents inserted into the thickness gauge.
Figure 4:
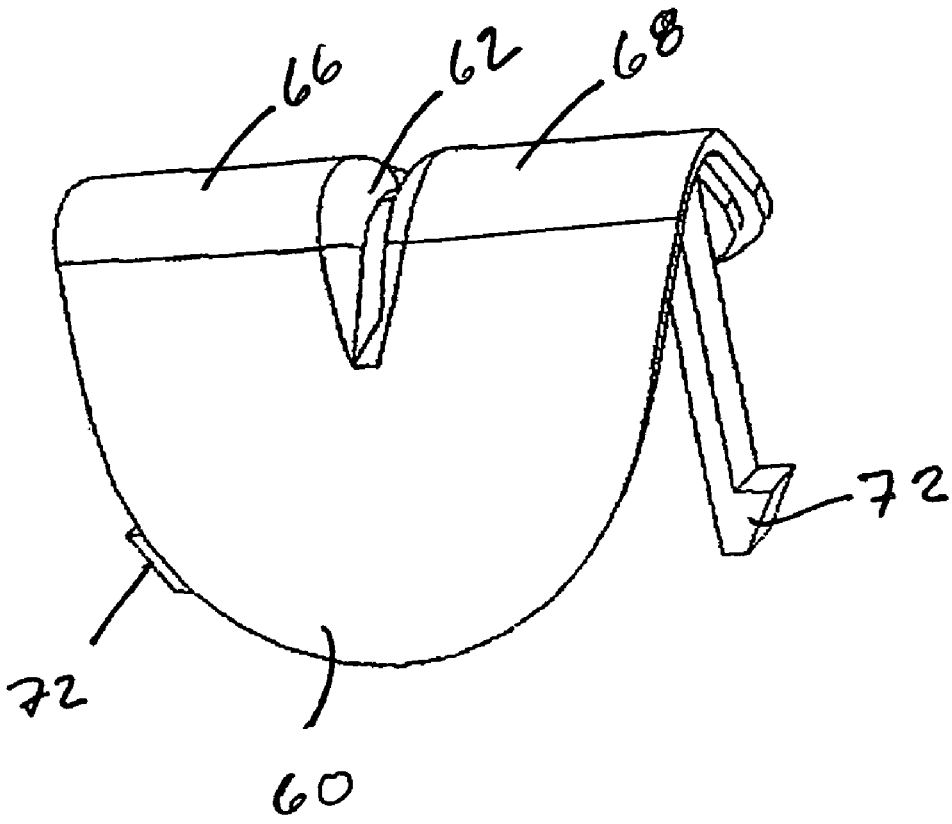
FIG. 4 is a close-up perspective view of the thickness gauge.

By providing the stack thickness gauge 60, the user can verify whether the stack he/she desires to shred is within or above the capability of the shredder mechanism 16. As can be seen in FIG. 2, if the stack 64 is too thick, the user will not be able to insert the edge portion of the stack into the substrate receiving opening 62, indicating that the stack thickness needs to be reduced. Likewise, as can be seen in FIG. 3, if the stack 64 is thinner than the width of the opening 62, it can be inserted therein, indicating that the stack 64 can be fed into the shredder mechanism 16 as is.

Typically, the width of the opening 62 will be selected based on the capacity of the shredder mechanism 16 to handle a stack of a given type of substrate. For example, most shredders are used to shred paper, and thus in most instances the thickness of opening 62 will be based on the maximum thickness for a stack of paper that the shredder mechanism 16 can handle. For specialized shredders dedicated to other substrates, the width of opening 62 may be based on the shredder mechanism's capacity to handle a relevant substrate other than paper.

Figure 5:
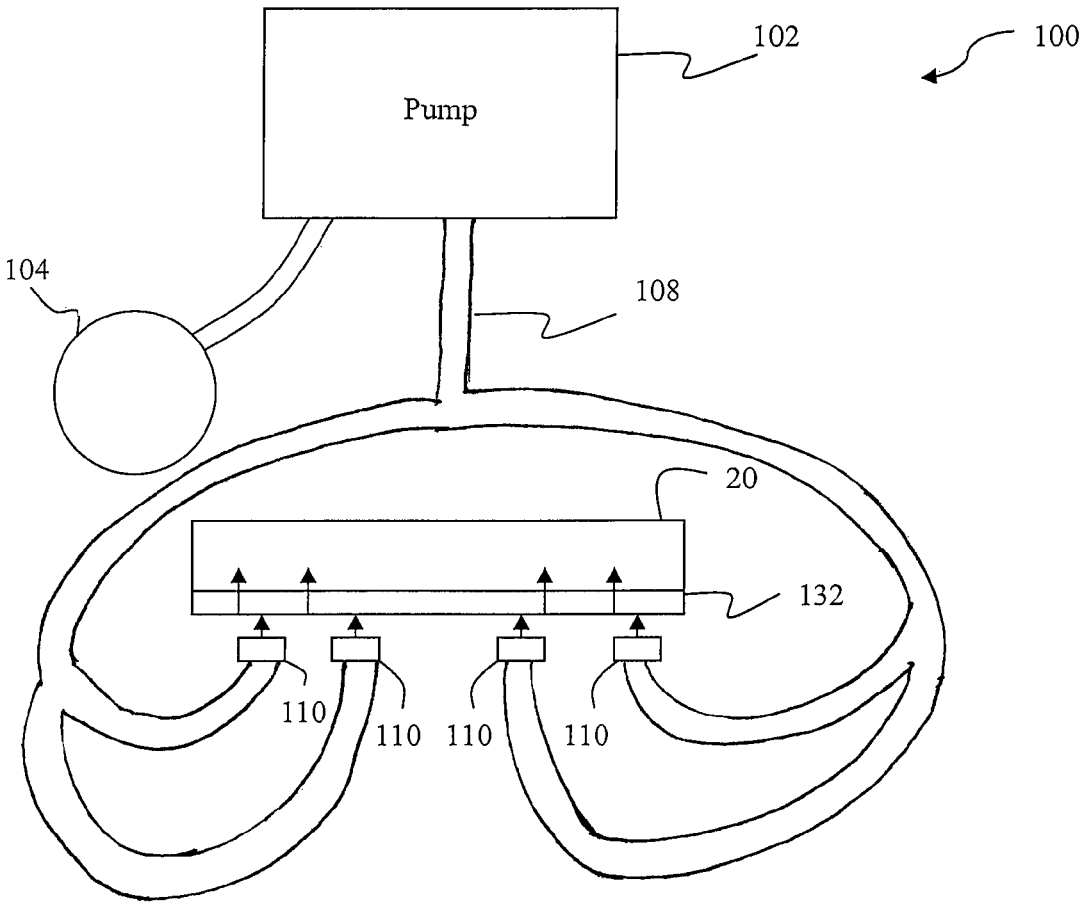
FIG. 5 is a schematic illustration of an oiling mechanism in accordance with an embodiment of the present invention.

As schematically illustrated in FIG. 5, in order to lubricate the cutting elements of the shredder 10, a system 100 is included for providing lubrication at the cutting elements 20. The system includes a pump 102, that draws lubricating fluid, such as oil, from a reservoir 104. In a typical application, the reservoir 104 will have a fill neck 106 that extends through the top wall 24 of the shredder housing 14 to allow for easy access for refilling the reservoir.

The pump 102 communicates through a series of conduits 108 to one or more nozzles 110 that are positioned proximate the cutting elements 20. In one embodiment, the nozzles can be positioned such that oil forced through the nozzles is dispersed as sprayed droplets in a throat of the shredder 10. In another embodiment, the oil is dispersed in back of the throat of the shredder 10. Generally, the nozzles have openings small relative to the conduits, thereby creating a high speed flow at the nozzle, allowing the oil to be expelled at a predictable rate and pattern.

Figure 6:
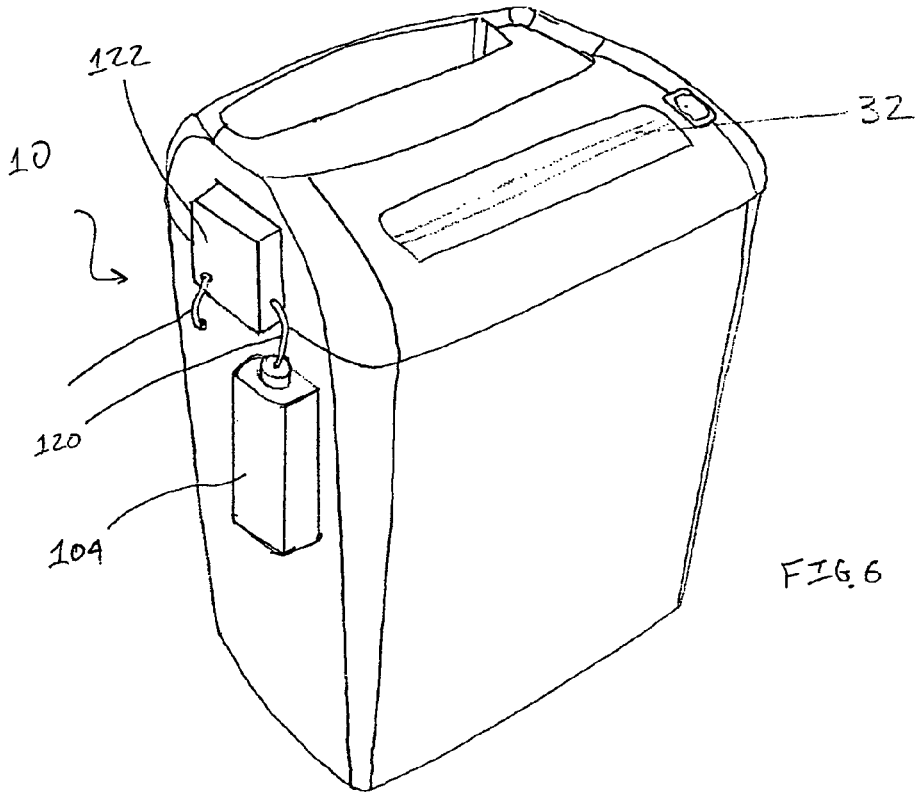
FIG. 6 is a perspective view of a shredder having an oiling mechanism in accordance with an embodiment of the present invention.

As shown in FIG. 6, a system in accordance with an embodiment of the present invention may be a retrofit device. In this embodiment, the reservoir 104 is mounted to an outside surface of the shredder 10. It is connected via a conduit 120 to the main unit 122. The main unit 122 may include a power supply (not shown) and the pump 102 (not shown in FIG. 6).

In any embodiment, the reservoir 104 may be designed to be removed and replaced, rather than re-filled.

Figure 7:
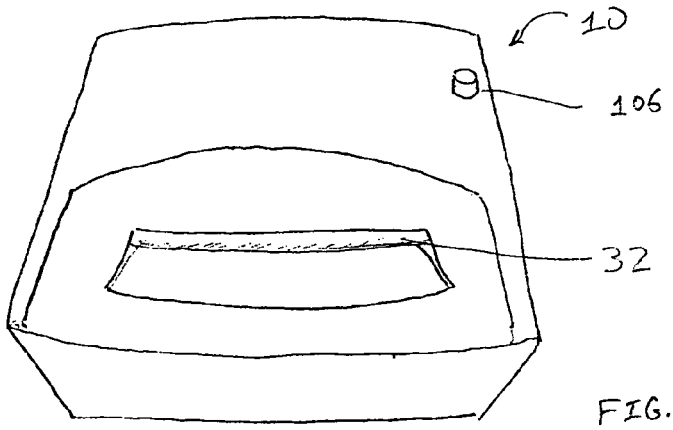
FIG. 7 is a perspective view of a shredder having an oiling mechanism in accordance with an embodiment of the present invention.

An alternate embodiment includes the system 100 built into the housing of the shredder 10. In this embodiment, shown in FIG. 7, the fill neck 106 can be designed to extend through the top wall 24 of the shredder housing 14. Operation of the system 100 does not depend on whether it is retrofit or built-in.

In operation, a controller 130 for the system 100 is programmed with instructions for determining when to lubricate the cutting elements 20. The controller processes the instructions and subsequently applies them by activating the pump 102 to cause fluid from the reservoir to be delivered to the nozzles 110 under pressure. The nozzles are positioned and arranged to spray the pressurized lubricating oil to the cutting elements 20. In general, the oil will be dispersed in a predetermined pattern directly onto the cutting elements and/or the strippers. In a particular arrangement, it may be useful to array the nozzles below the cutting elements so that lubrication is sprayed from below. In an alternate embodiment, the oil is sprayed onto an intermediate surface 132 (shown in FIG. 5) and allowed to drip from there onto the cutting elements and the strippers (which are generally located on the outward or post-cutting side of the cutting mechanism and include a serrated member or a comb type member having teeth that protrude into the spaces between the individual cutting disks).

Within the scope of the present invention, the controller may be programmed to operate the pump in a number of different modes. In one embodiment, the controller is programmed to operate according to a predetermined timing schedule. In another, the controller activates the pump upon a certain number of rotations of the drive for the cutting elements. In another embodiment, a sensor at the throat of the shredder monitors a thickness of items deposited therein. Upon accumulation of a predetermined total thickness of material shredded, the controller activates the pump to lubricate the cutting elements. It is also possible to schedule the lubrication based on a number of uses of the shredder (e.g., the controller tracks or counts the number of shredding operations and activates the pump after a predetermined number of shredder operations). In each of the embodiments making use of accumulated measures, a memory can be incorporated for the purpose of tracking use. In each foregoing embodiment, the mechanism may include a manual control to allow a user to operate the system outside of the schedule determined by the controller.

In another embodiment, the motor controller may be configured to monitor a load on the motor 18. A large load on the motor may be indicative of resistance to the motion of the cutting elements, in turn indicating that a large amount of paper or a relatively tough substrate such as a CD is being shredded. In this embodiment, the load monitoring function may be used as a trigger for lubrication of the cutting elements. For example, a current or voltage sensor may sense the resistance across the shredder mechanism's motor. An increase in the voltage drop across the motor (or a decrease in current flaming to the motor) will indicate an increase in the mechanical resistance faced by the motor. As such, when the electrical resistance, voltage drop, or current (all of which are related, so any one may be monitored directly or indirectly) reaches a threshold valve, the controller may activate the pump to spray the lubricant.

In another embodiment, the lubrication system may have a manual control that allows for hand actuating of the lubrication pump. For example, a bulb may be hand-actuatable for pressurizing the lubricating fluid. Likewise, a user-activated button may be used to manually engage a pump.

The foregoing illustrated embodiment has been provided to illustrate the structural and functional principles of the present invention and is not intended to be limiting. To the contrary, the present invention is intended to encompass all modifications, alterations and substitutions within the spirit and scope of the appended claims.

What is claimed:

1. A shredder for shredding substrates, comprising:

a housing;

a shredder mechanism received in the housing and including a motor and cutting elements, the shredder mechanism enabling substrates to be shredded to be fed into the cutting elements and the motor being operable to drive the cutting elements in a shredding direction so that the cutting elements shred the substrates fed therein;

the housing having a feed opening enabling the substrates to be shredded to be fed into the cutting elements;

a reservoir constructed to contain an amount of fluid lubricant;

a plurality of spray nozzles communicated with the reservoir, the nozzles having openings for spraying the fluid lubricant under pressure; and a pump, operable to deliver the fluid lubricant under pressure to the plurality of nozzles such that the fluid is sprayed to lubricate the cutting elements; and an intermediate surface, positioned with respect to the nozzles and the cutting elements such that fluid sprayed from the nozzles impinges directly on the intermediate surface, and flows from the intermediate surface to the cutting elements.

2. A shredder as in claim 1, wherein, when in operation, the fluid is sprayed in a predetermined pattern onto the cutting elements.

3. A shredder as in claim 1, further comprising a controller, configured and arranged to control operation of the pump.

4. A shredder as in claim 3, wherein the controller is configured to operate the pump to spray the fluid according to a predetermined schedule.

5. A shredder as in claim 4, wherein the controller monitors a number of rotations of the cutting elements during shredding operations and wherein the controller is configured to operate the pump to spray the fluid in response to a measured number of rotations of the cutting elements.

6. A shredder as in claim 4, wherein the controller monitors a total thickness of material shredded by the shredder during shredding operations and wherein the controller is configured to operate the pump to spray the fluid in response to a measured total thickness of material shredded by the shredder reaching or exceeding a predetermined value.

7. A shredder as in claim 1, further comprising a stack thickness gauge having a substrate receiving opening configured to receive an edge portion of a stack of substrates therein, the substrate receiving opening having a width less than or equal to a maximum thickness of a stack of substrates that the shredder mechanism is capable of shredding.

8. A shredder as in claim 7, further comprising a sensor configured to measure a thickness of the edge portion of the stack of substrates when inserted into the substrate receiving opening.

9. A shredder as in claim 8, further comprising a memory, configured to receive from the sensor, data relating to the measured thickness, and to store an accumulated total thickness.

10. A shredder as in claim 9, further comprising a controller, in communication with the memory and configured and arranged to control operation of the pump in response to the stored accumulated total thickness reaching or exceeding a predetermined value.

11. A shredder as in claim 1, wherein the intermediate surface is positioned between the nozzles and the cutting elements.

12. A shredder for shredding substrates for use with a removable reservoir containing a fluid lubricant, comprising:

a housing;

a shredder mechanism received in the housing and including a motor and cutting elements, the shredder mechanism enabling substrates to be shredded to be fed into the cutting elements and the motor being operable to drive the cutting elements in a shredding direction so that the cutting elements shred the substrates fed therein;

the housing having a feed opening enabling the substrates to be shredded to be fed into the cutting elements;

an inlet opening constructed to be removably engaged with the removable reservoir for receiving the fluid lubricant;

at least one spray nozzle communicated with the inlet openly, the nozzles having openings for spraying the fluid lubricant under pressure;

a pump, operable to deliver the fluid lubricant under pressure to the at least one nozzles such that the fluid is sprayed to lubricate the cutting elements; and an intermediate surface, positioned with respect to the nozzles and the cutting elements such that fluid sprayed from the nozzles impinges directly on the intermediate surface, and flows from the intermediate surface to the cutting elements.

* * * * *